US006523513B2

(12) United States Patent
Speier

(10) Patent No.: US 6,523,513 B2
(45) Date of Patent: Feb. 25, 2003

(54) CAMSHAFT TIMING DEVICE FOR INTERNAL COMBUSTION ENGINES

(75) Inventor: Wolfgang Speier, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/112,605

(22) Filed: Mar. 16, 2002

(65) Prior Publication Data

US 2002/0148423 A1 Oct. 17, 2002

Related U.S. Application Data

(63) Continuation-in-part of application No. PCT/EP00/08686, filed on Sep. 6, 2000.

(51) Int. Cl.[7] ..... F01L 1/34

(52) U.S. Cl. ..... 123/90.17; 123/90.15; 123/90.34

(58) Field of Search ..... 123/90.15, 90.16, 123/90.17, 90.18, 90.34

(56) References Cited

U.S. PATENT DOCUMENTS 4,895,113 A 1/1990 Speier et al.
4,903,650 A 2/1990 Ohlendorf et al.
5,088,456 A 2/1992 Suga
5,263,442 A 11/1993 Hara
5,361,735 A * 11/1994 Butterfield et al. ..... 123/90.17

FOREIGN PATENT DOCUMENTS

DE 196 54 926 11/1997
DE 198 17 319 10/1999

* cited by examiner

*Primary Examiner*—Thomas Denion
*Assistant Examiner*—Jaime Corrigan
(74) *Attorney, Agent, or Firm*—Klaus J. Bach

(57) ABSTRACT

In a camshaft timing device for an internal combustion engine having a camshaft driven from a driveshaft by way of a camshaft drive which is capable of advancing or retarding the camshaft and therefore the valve timing, the camshaft drive is mounted onto the camshaft by a clamping screw which has a cylindrical opening in which a valve spool is movably disposed for controlling admission of hydraulic fluid to, and its release from, the camshaft drive, the valve spool being actuated by an electromagnetic motor acting against a valve spring biasing the valve spool in one direction for controlling the operation of the hydraulic camshaft drive and the valve spool is pressure balanced for accurate positioning control thereof.

8 Claims, 2 Drawing Sheets

CAMSHAFT TIMING DEVICE FOR INTERNAL COMBUSTION ENGINES

This is a Continuation-In-Part application of International Application PCT/EP00/08686 filed Sep. 6, 2000 and claiming the priority of German application 199 44 535.4 filed Sep. 17, 1999.

BACKGROUND OF THE INVENTION

The invention relates to a camshaft timing device or internal combustion engines, which timing device is located in the crankshaft drive and adapted to adapt the angular position of the camshaft relative to the drive depending on vehicle operating conditions.

DE 196 54 926 A1 discloses a camshaft timing device which is located In the drive of a camshaft from the crankshaft of an internal combustion engine. It is arranged coaxially with the camshaft and is connected to the camshaft via a central tension screw which, in turn, forms a valve housing, receiving an axially displaceable control spool, via which the supply connections of the camshaft timing device are to be completed, depending on the position of the spool, to the hydraulically operated timing-device. The connection path runs via an annular space which is provided circumferentially on the control spool and is delimited by two annular shoulders and which, depending on the axial position of the control spool, is in communication selectively with the delivery-side or return-side passages. The return passage extends, by an annular duct, which is offset axially relative to the annular space and is delimited by an annular web n to a central drain passage of the control spool. The drain passage extends to a valve housing space, which adjoins the receiving bore for the control spool in the direction of the camshaft. It is delimited, by one end face of the control spool and receives a return spring for the control spool. The threaded part of the tension screw is screwed axially into the camshaft. A return bore, which extends through the threaded part and, via a transverse bore in the camshaft, leads to an oil-collecting space, which is formed by the oil sump of she internal combustion engine, to which the camshaft drive chain case that supports the camshaft timing device of the internal combustion engine, is connected.

Camshaft timing devices of this type are intended to permit high engine speeds and accurate valve timing with low actuating forces, and at the same time have low space requirements, providing particularly for a short construction length. These factors are also determined to a large degree by the fluid passages at the return side which return the fluid to the oil-collection sump and which are also critical, since any back pressure will affect the response time and undesirable vibrations may also occur.

The problems referred to assume increased importance when, as has already been proposed (DE 198 17 319.9-13), the camshaft timing device does not operate under excess fluid pressure from one side of the actuator, but is pressurized at both sides and therefore has to operate at the control side not with a 3/2-way valve, but with a 4/2-way valve.

SUMMARY OF THE INVENTION

In a camshaft timing device for an internal combustion engine having a camshaft driven from a driveshaft by way of a camshaft drive which is capable of advancing or retarding the camshaft and therefore the valve timing, the camshaft drive is mounted onto the camshaft by a clamping screw which has a cylindrical opening in which a valve spool is movably disposed for controlling admission of hydraulic fluid to, and its release from, the camshaft drive, the valve spool being actuated by an electromagnetic motor acting against a valve spring biasing the valve spool in one direction for controlling the operation of the hydraulic camshaft drive and the valve spool is pressure balanced for accurate positioning control thereof.

Concerning a camshaft timing device operating with a 4/2-way valve according to the invention, one possible solution in which, irrespective of the actuating direction of the control slide, forces of the working medium on the control slide spool which affect its behavior are avoided and, moreover, a simplified routing of the fluid supply line paths is achieved, along with a simplified structural set-up.

The solution according to the invention also makes it possible, to integrate the valve-side connection to the delivery-side supply connection into the valve in an advantageous way, so that, in this regard, there is no need for any additional actions on the camshaft or on the mounting of the camshaft on the camshaft bearing.

An exemplary embodiment of the invention is explained in more detail below with reference to the drawings.

DESCRIPTION OF AN EXEMPLARY EMBODIMENT

Figure 1:
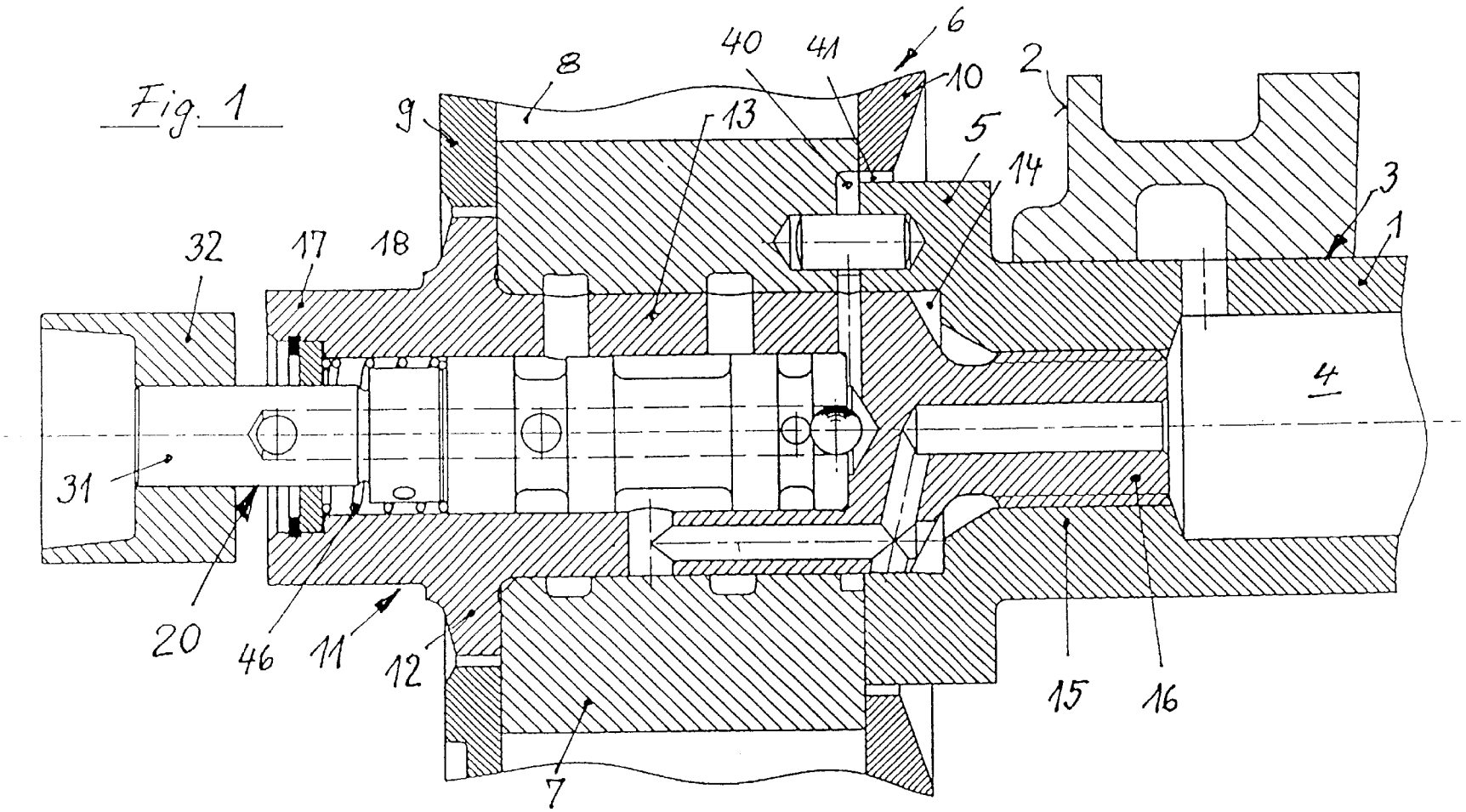
FIG. 1 shows a longitudinal section through a camshaft timing device which is connected to the camshaft shaft of an internal combustion engine, not illustrated, and which is designed as a rotary actuator THAT IS known per se.
Figure 2:
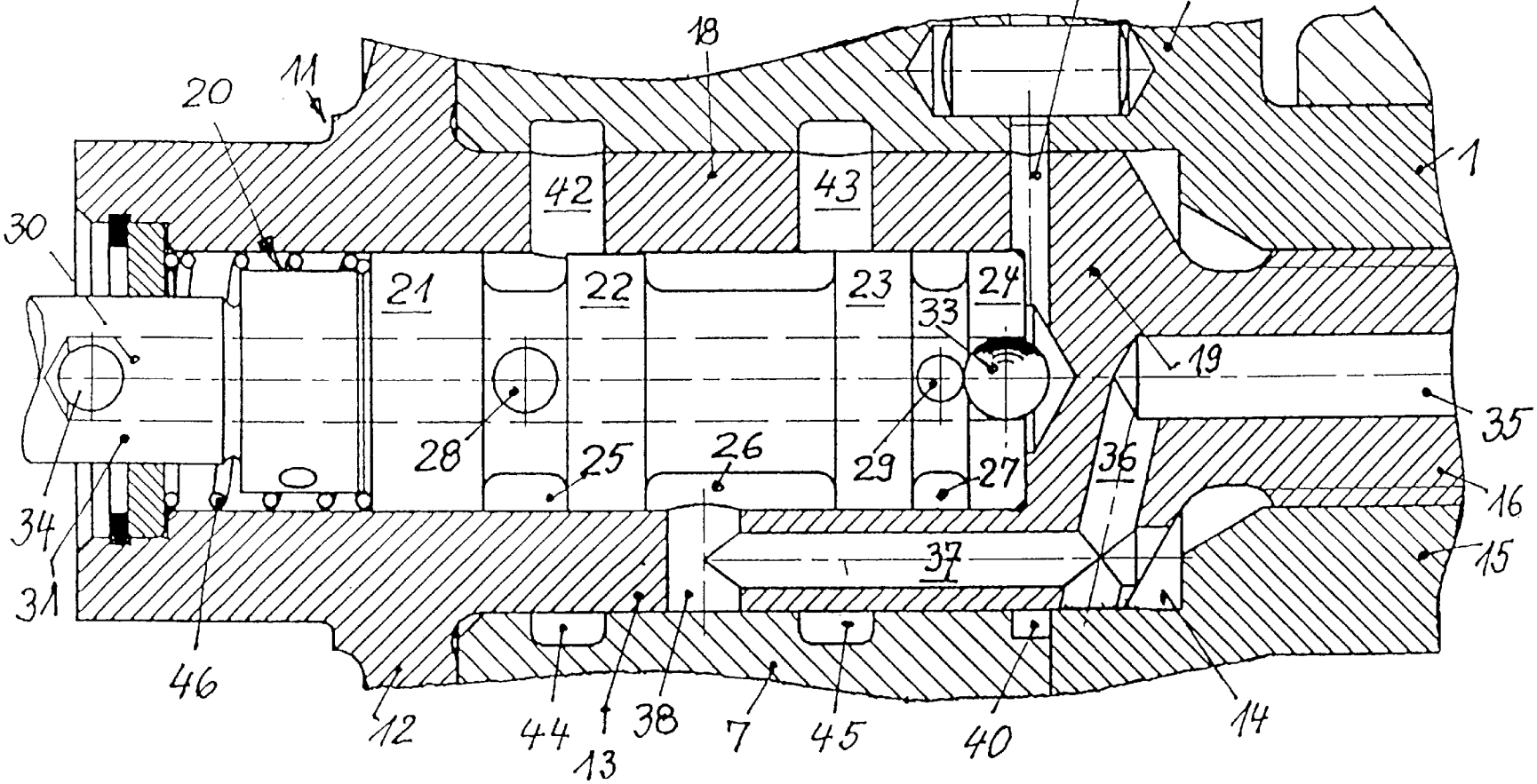
FIG. 2 shows an enlarged detail representing the central region of FIG. 1.

The reference numeral 1 designates the camshaft which is mounted in the housing of an internal combustion engine, or in its cylinder head. In the figure the bearing assigned to one end wall 2 of the housing or of the cylinder head is illustrated partially and is designated by the reference numeral 3. The camshaft 1 is provided with a central oil bore 4. In its end region the camshaft 1 projects beyond the end wall 2. It carries a fastening flange 5, against which the camshaft timing device 6, illustrated here only partially, is braced and centered.

In the illustration, the fastening flange 5 is formed on the camshaft 1. Within the scope of the invention, however, it is, of course, also possible for the fastening flange 5 to be part of an end piece of a composite structure including a camshaft tube which carries the cams in an appropriate relative arrangement.

Of the camshaft timing device 6, only the inner body 7 is illustrated here, which has radially outward-projecting vanes 8 and is assigned an outer body, not shown, with radially inward-projecting vanes which overlap with the vanes 8 of the inner body 7 and, in conjunction with the side walls 9 and 10, delimit relative to one another working chambers which, by being appropriately pressure-loaded, are variable in their respective volume and thereby rotate the inner body and outer body relative to one another. Such a timing device is disc used for example in detail in DE 198 17 319 A1. The timing device as such is not part of the present invention.

The crankshaft of the internal combustion engine, which is not illustrated in detail, is connected fixedly in terms of rotation, for example by means of a chain drive, to the outer body, not illustrated, of the camshaft shaft timing device 6, so that, by the working chambers being pressurized as a function of the desired adjusting direction and by the corresponding rotation of the inner body 7 relative to the outer body, the phase relation of the camshaft 1 with respect to the crankshaft can be changed.

The inner body 7 is centered and axially braced against the flange 5 of the camshaft via a clamping screw 11. For this purpose, the clamping screw 11 includes a clamping collar 12 which extends over, and engages, the inner body 7 in the radially inner region and which is radially surrounded by the side wall 9. The clamping screw 11 has a shank 12, which extends centrally through the inner body 7, so that the latter is centered via the shank 13. With its end region remote from the clamping collar 12, the shank 13 is fitted into a central opening 14 in the fastening flange 5. The damping screw 11 extends, in the direction of the oil bore 4 of the camshaft 1, into a portion of the camshaft 1, which is configured as a threaded bush 15 and into which the clamping screw 11 is screwed via its threaded neck 16. The neck 16 lies in the extension of the shank 13. Its outside diameter is reduced in relation to that of the shank 13. The threaded neck 16 which is screwed into that end region of the camshaft 1, which is configured as a threaded bush 15, forms an end-face plug of the oil bore 4 of the camshaft 1 and is likewise concentric to the camshaft 1.

The clamping screw 11 is hollow over the length of its shank 13 and the head region 17 which extends from the tension collar 12. It forms a cylindrical housing 18 which is closed opposite the head region 17 by a bottom well 19 disposed at the transition from the shank 13 to the threaded neck 16. The housing 18 receives a control spool 20 provided with annular webs 21 to 24, which are spaced axially from one another and the outside diameter of which corresponds to the inside diameter of the cylindrical housing 18. Between successive annular webs are in each case regions of the control spool 20, which are of reduced diameter so that the annular webs 21 and 22 axially delimit an annular passage 25, the annular webs 22 and 23 delimit an annular space 26 and the annular webs 23 and 24 delimit an annular passage 27.

The annular spaces 25 and 27 are connected via radial bores 28, 29 to a return bore 30 which, starting from the rearward end of the control spool 20, which end is opposite the head region 17 of the clamping screw 11, terminates in a stub region 31 of the control spool 20. The stub region projects beyond the head region 17 of the clamping screw 11 and, in its end area, carries the armature 32 of a magnetic actuator. The magnetic actuator is provided as an actuating drive having a coil structure extending around the armature 32. It is mounted to the 20 cover of the drive chain case in which the camshaft timing device 6 and its drive to the crankshaft are received.

The return bore 30 is closed at that end of the control spool 20 which terminates in the annular web 24, the 25 plug provided being illustrated symbolically by a ball 33 pressed into the return bore 30. In the closed end region of the return bore 30, which terminates in the stub 31, The return bore is in communication with a transverse bore 34, which extends to the drive chain case and consequently to the oil-collecting space of the internal combustion engine, to which oil-collecting space the chain case is also connected.

In addition to the described return-side flow path, which is defined essentially by the central return bore 30 and its exit into the oil-collecting space, there is, at the inflow side, that is the delivery side, a central connecting bore 35, which extends through the neck 16 of the clamping screw 11 to the bottom region 19 of the clamping screw. An adjoining a transverse bore 36 extends radially toward the surface of the bottom region 19 and intersects a longitudinal bore 37 extending in the shank 13 to a radial bore 38 in the shank 13. The bores 35 to 38 intersect one another in each case with respect to their axes. Furthermore, the bore 35 emanates from the free end face of the threaded neck 16, whilst the bores 36 and 37 emanate from the outer circumference of the shank 13 in the region of the bottom region 19 or from the outside of the bottom region 19 (bore start) and are open towards the corresponding outer surfaces. The bore 38 is designed as a through bore which, however is radially outwardly sealed by the adjacent inner body 7. The open ends form the beginning of the bores 36 and 37. They lie in the region of the overlap of the shank 13 with the receptacle 14 in the fastening flange 5. The fit of the shank 13 in the receptacle 14 achieves a sufficiently leak-tight closure of the annular corner region which is delimited radially inwards by the threaded neck 16 at the transition to the bottom 19 and radially outwardly by the fastening flange 5. The end region of the housing 18, which is closed by the bottom 19, is connected to a venting bore 39 which extends radially onto an end-face annular duct 40 in the inner body 7. The annular duct is located at the transition of the inner body 7 to the fastening flange 5 and has a venting connection 41, which extends out between the inner body 7 and he fastening flange 5 and terminates in the chain case.

Provided in the cylindrical housing 18 formed by the clamping screw 11 are connections 42 and 43 located on the timing-device side. The connections 42 and 43 are spaced axially from one another and are formed in each case by radial bores, to which correspond, in the inner body 7, annular passages 44 and 45, via which the working chambers, not shown, located between the inner body and the outer body, not shown, are supplied.

In the illustrated end position of the control spool 20, towards which the latter is biased by the spring 46, the working chambers, not shown, connected to the annular chamber 45 are pressurized, whilst the working chambers connected to the annular chamber 44 are in communication with the oil return and the oil-collecting chamber. The annular space 26 is connected correspondingly to the pressure source and constitutes the connection between the radial bore 38, as part of the supply-side connection, and the bore 43, as part of the timing-side connection. The annular ducts 25 and 27, by being connected to the return bore 30 via the bores 28 and 29, are both largely pressureless, but in any event are subjected to the same pressure, if a corresponding dynamic pressure should build up briefly during the emptying of the working chambers connected to the timing-device side connection 42. Therefore, pressure fluctuations, whether on the inflow side or on the outflow side, have no influence on the control spool 20 and the actuating forces necessary for adjusting the control spool 20. This also apolies when the control spool 20 is displaced out of the position shown, to the left in the drawing, via the armature 32 into a blocking position, in which the annular webs 22 and 23 overlap with connections 42 and 43 or, beyond this, into a reversing position, in which the annular space 26 overlaps with the connection 42 and the connection 43 is in communication with to the annular passage 27.

Apart from the fact that the corresponding pressurization of the annular ducts 25 and 27 rules out pressure dependent actuating forces on the control spools 20, the central outflow-side connection formed by the return bore 30 allows a direct outflow through outflow passage with a relatively large cross section. The size of this outflow cross section has virtually no influence on the construction length of the camshaft timing device and, in particular, also is simple to produce. The bore routing in the pressure-side connection path makes measures affecting the camshaft as such unnecessary and even makes it possible to arrange the corresponding connection paths in the housing 18, formed by the clamping screw 11, for the control spool 20. The device therefore forms a unit which is ready for installation and which, by virtue of being inserted with a leak-tight fit relative to the inner body 7 and to the receptacle 14, makes it unnecessary to use any special sealing structures.

Overall, in the solution according to the invention, high pressures and large volume flows can be controlled without adversely affecting the adjustment accuracies of he control spool and of the actuating forces necessary, so that, if appropriate, with a view to overall dimensions, a relatively small bore and small duct cross sections can be utilized, and a very fine setting of the described 4/2-way proportional valve according to the invention is possible.

What is claimed is:

1. A camshaft timing device for an internal combustion engine having a camshaft driven by a drive shaft by way of a camshaft drive mounted co-axially onto said camshaft, a clamping screw extending through said driveshaft and into a central openings in said camshaft for engaging said drive with said camshaft, said clamping screw having a cylindrical opening providing for a valve housing, a valve spool axially movably disposed in said cylindrical opening, a control spring disposed in said cylindrical opening so as to bias said valve spool toward an end position, a valve spool actuating drive disposed on said clamping screw for moving said valve spool against the force of said control spring, said valve housing having two axially spaced control openings for supplying hydraulic fluid to, and releasing it from, a timing motor of said timing device, said valve spool having two spaced annular webs sealingly disposed in said cylindrical opening at a distance from each other corresponding essentially to the spacing between said control openings and forming therebetween a pressurized fluid supply chamber, which is in communication with a fluid supply bore in said camshaft, said spool including fluid release chambers at opposite sides of said annular webs which fluid release chambers are in communication with a fluid drain passage by way of a connecting passage extending centrally through said valve spool, said valve spool being movable by said actuating drive against the force of said spring to place one of said control openings into communication with said pressurized fluid supply chamber for supplying pressurized fluid to said camshaft drive through said one control opening and the other of said control openings in communication with one of said pressure release chambers for releasing fluid from said camshaft drive to said drain passage and said valve spool being movable by said spring in the opposite direction to place the other of said control openings into communication with said pressurized fluid supply chamber for supplying pressurized fluid to said camshaft drive through said other control opening and to place said one control opening in communication with other pressure release chamber for discharging fluid from said camshaft drive through said one control opening for controlling operation of said camshaft drive.

2. A camshaft timing device according to claim 1, wherein the connection of the annular passage to the fluid drain passage is made via a transverse bore.

3. A camshaft timing device according to claim 1, wherein the connecting passage extending centrally through said valve spool is closed at the camshaft-side end of the valve spool.

4. A camshaft timing device according to claim 1, wherein the camshaft-side end of the valve control spool is formed by the annular web delimiting an end region of said housing, the end region of the housing of the control spool which is delimited via said annular web having a drain connection.

5. A camshaft timing device according to claim 1, wherein said clamping screw has, in its camshaft-side end region, a central connecting bore forming a pressure-side supply connection which leads to a central oil supply bore of said camshaft.

6. A camshaft timing device according to claim 5, wherein the central connecting bore is connected to the pressurized fluid supply chamber by means of bores formed in said clamping screw .

7. A camshaft timing device according to claim 6, wherein some of the bores extending in said clamping screw have a bore opening terminating at the outer surface of the clamping screw and that the respective bore openings are in communication by way of a connecting space formed in said central opening of the camshaft.

8. A camshaft timing device according to claim 7, wherein said clamping screw is tightly fitted at least into the end region of said central openings and seals off said central opening.

* * * * *